US005538792A

United States Patent [19]

Jacob et al.

[11] Patent Number: 5,538,792

[45] Date of Patent: Jul. 23, 1996

[54] PROCESS FOR DRAWING HEATED YARNS, THEREBY OBTAINABLE POLYESTER FIBERS, AND USE THEREOF

[75] Inventors: Ingolf Jacob, Untermeitingen; Josef Geirhos, Bobingen, both of Germany

[73] Assignee: Hoechst Aktiengesellschaft, Frankfurt am Main, Germany

[21] Appl. No.: 90,787

[22] Filed: Jul. 12, 1993

[30] Foreign Application Priority Data

Jul. 10, 1992 [DE] Germany ..... 42 22 720.8

[51] Int. Cl.[6] ..... D02G 3/00

[52] U.S. Cl. ..... 428/364; 428/395; 264/211.17

[58] Field of Search ..... 428/364, 395; 264/211.17

[56] References Cited

U.S. PATENT DOCUMENTS

| | | | |
|---|---|---|---|
| 3,110,547 | 11/1963 | Emmert | 264/211.17 |
| 3,606,689 | 9/1971 | Matsuo et al. . | |
| 3,694,872 | 10/1972 | Sundbeck | 28/71.3 |
| 3,724,038 | 4/1973 | Chimura et al. | 28/1.2 |
| 3,824,778 | 7/1974 | Flanders, Jr. et al. | 57/157 F |
| 4,183,895 | 1/1980 | Luise | 264/211.17 |
| 4,255,377 | 3/1981 | Dauimit et al. | 264/211.17 |
| 4,378,325 | 3/1983 | Waite | 264/211.17 |
| 4,415,521 | 11/1983 | Mininni et al. | 264/211.17 |
| 4,529,378 | 7/1985 | Runkel et al. | 432/50 |
| 4,549,361 | 10/1985 | Brough et al. | 28/240 |
| 4,680,872 | 7/1987 | Bauer | 28/248 |
| 4,687,610 | 8/1987 | Vassilotos | 264/211.17 |
| 4,731,217 | 3/1988 | Gerhartz et al. | 264/211.17 |
| 4,973,657 | 11/1990 | Thaler | 428/364 |
| 5,108,675 | 4/1992 | Matsuo et al. | 264/211.17 |
| 5,141,693 | 8/1992 | Hsu | 264/211.17 |

FOREIGN PATENT DOCUMENTS

| | | |
|---|---|---|
| 0193891 | 10/1986 | European Pat. Off. . |
| 0114298 | 7/1987 | European Pat. Off. . |
| 967805 | 12/1957 | Germany . |
| 2374139 | 3/1974 | Germany . |
| 7125354 | 3/1975 | Germany . |
| 1908594 | 11/1976 | Germany . |
| 2927032 | 6/1983 | Germany . |
| 83129855 | 11/1983 | Germany . |
| 3344215 | 6/1984 | Germany . |
| 3431831 | 3/1986 | Germany . |
| 7018370 | 12/1971 | Netherlands . |
| 1216591 | 12/1970 | United Kingdom . |

*Primary Examiner*—N. Edwards
*Attorney, Agent, or Firm*—Connolly & Hutz

[57] ABSTRACT

There is described a particularly gentle and fast process for heating and drawing yarns by passing them contactlessly through a heating apparatus at high speed.

Polyester fibers have a tenacity index TI equal to or greater than 50 and a molecular orientation MO equal to or greater than 20 or a compliance COM equal to or less than 12 and a storage modulus index SMI equal to or greater than 100.

The polyester fibers of the invention can be used in particular for reinforcing plastics or for producing dimensionally stable textile fabrics.

4 Claims, 1 Drawing Sheet

PROCESS FOR DRAWING HEATED YARNS, THEREBY OBTAINABLE POLYESTER FIBERS, AND USE THEREOF

The present invention relates to a novel process whereby fast moving yarns can be heated rapidly, gently and uniformly across the cross-section to a desired elevated temperature, to polyester fibers of high strength, high modulus and low shrinkage that are preparable by the process of the invention, and to the use of these fibers as reinforcing materials or for producing textile fabrics.

DESCRIPTION OF THE PRIOR ART

Heating plays a large part in the art of yarn making and processing; accordingly, a large number of heating processes and apparatuses are known.

These processes and apparatuses can be classified for example according to the manner of heat supply. For instance, it is customary to supply the heat by means of heat transfer media, for example hot liquids or gases, by contact with the yarn. It is also customary to transfer the heat from hot surfaces by radiation therefrom or contact therewith.

Similarly, a number of processing operations on fast moving yarns, for example drawing or setting, necessitate heating. It is common knowledge that in these operations the heat should be supplied as rapidly and gently as possible.

The rate of heat transfer is known to depend fundamentally on the temperature gradient between the heat supply and the object to be heated. To maximize the rate of heat transmission, it is common to use the highest possible temperature for the heating medium. However, an excessively high temperature causes overheating of parts of the yarn bundle, such as protruding individual filaments or loops. There is therefore a conflict between the demands for the very rapid yet also gentle treatment.

DE-A-3,431,831 discloses a process for drawing polyester yarn in-line. The process is carried out at reduced speeds. No details are given of the heating of the moving yarns.

EP-A-114,298 discloses a heating chamber for moving yarns wherein the yarns are treated with saturated steam at more than 2 bar. The heating chamber is characterized by a special form of seal for the yarn inlet and outlet, which gives a good sealing effect, allows simple threading, and makes possible rapid attainment of the operational state after threading. According to the description, heat transfer takes the form in particular of condensation of the saturated steam on the yarn in the heating chamber, thereby ensuring a high uniformity of the treatment temperature. The yarn leaving the heating chamber thus generally contains condensed water, which evaporates again in the subsequent operations. The treatment temperature in this heating chamber is not readily variable, since it corresponds to the temperature of the saturated steam.

EP-A-193,891 discloses a heating means for a crimping machine. Said heating means comprises an upright or inclined yarn guide tube which is heated on its outer surface. To improve the heat transmission to the moving yarn, the yarn inlet side of the yarn guide tube is fitted with an air nozzle through which fresh air is blown into the yarn tube. This device is intended to make the heat treatment more effective. The actual heating of the fresh air takes place only in the heating means itself. This heating means cannot be used to carry out a heat treatment at constant temperatures, since the air in the yarn guide tube does not have a defined temperature.

DE-A-2,927,032 discloses apparatus for texturing yarns wherein the yarns are heated directly in yarn ducts through which hot air flows. The yarn ducts are supplied with hot air and are connected to a suction tube. The apparatus is characterized by a special arrangement of the inlet and outlet lines for the hot air and the heating apparatus for the hot air; furthermore, inlet and outlet ports are provided on the yarn ducts for feeding and discharging the yarns. The apparatus described is intended to achieve accurate temperature control and high temperature uniformity within the apparatus. The yarns are directly surrounded by a uniform stream of hot air, which ensures uniform heating of the yarns at a constant temperature and air speed. The apparatus requires aspiration of the spent hot air via a separate suction tube.

DE Utility Model 83 12 985 discloses apparatus for texturing yarns wherein there is provided a heating apparatus in which hot air heats a moving yarn in a yarn duct. The apparatus is characterized by the special air guidance system in the yarn duct, having in each case one feed line between at least two return lines for the hot air. The apparatus is intended to minimize the temperature drop in the yarn duct between the inlet and outlet thereof. The yarn is impinged by the hot air at one point as in an injector nozzle, and then the yarn and the air move together or in opposite directions, the air giving off its heat.

GB-A-1,216,519 discloses a process for heating a thermoplastic yarn using a contact heater. In this process, a continuously moving yarn passes through a yarn duct in the form of a capillary. The internal diameter of the yarn duct is such that fluids cannot move freely within this duct but, because of the capillary nature of the yarn duct, produce a sealing effect. This yarn duct is charged with a pressurized heating fluid, for example air, superheated steam or saturated steam, so that it can move through the heating duct together with the yarn in the yarn transport direction and plasticates the yarn by contact. Owing to the construction of this apparatus, it has to be assumed that a steep temperature gradient will develop in the yarn duct in the yarn transport direction and that, as a consequence of the small amounts of heating fluid in the capillary of the yarn duct, it is necessary to operate at a heating fluid temperature which is far above the desired yarn temperature.

DE-C-967,805 discloses a process and apparatus for setting moving yarns as they are being false twisted. The process consists in the contactless movement of a surface-moistened high-twist yarn through a heating apparatus which contains hot air. The false twist is set by utilizing a high relative movement between the hot air and the moving yarn. According to the description, the process is carried out in such a way that a high temperature gradient forms between the hot air and the yarn; the moistening of the surface accordingly is designed to protect the yarn from thermal damage.

DE-B-1,908,594 discloses apparatus for heat treating relaxed synthetic yarns wherein a yarn is passed through a hollow heating cylinder. The yarn inlet is equipped with an injector in the form of an annular nozzle driven by a primary gas stream of heating gas, and with an additional inlet for a secondary gas stream. The apparatus is characterized in that the additional inlet for the secondary gas stream is arranged in such a way that this stream meets the primary gas stream in the heating cylinder at a point, viewed in the transport direction of the yarn, behind the injector outlet. The apparatus is intended to avoid the formation of vortices in the heating cylinder, and the quality of the treated yarns is to be improved. Vortexing is a danger because the primary gas stream enters the heating cylinder at a relatively high speed and slows down therein.

DE-A-2,347,139 discloses a process for texturing thermoplastic yarn by setting the twisted yarn by means of hot steam passed through the heating means at the speed of sound. The heating medium is here likewise fed in at the yarn inlet point of the heating apparatus by means of an annular nozzle. The process is notable for high productivity. The heating of the yarn is effected by contact with a comparatively small mass of the steam in fast, turbulent flow, this steam having an elevated temperature compared with the desired final temperature of the moving yarn.

Finally, DE-A-3,344,215 discloses a yarn heater comprising a heated yarn tunnel. This heater is characterized in that it contains means through which a heated medium impinges on a yarn moving along this tunnel in the region of the yarn inlet. The heating medium is here likewise fed in by means of an annular nozzle. The heater is intended to increase the heating power, so that shorter heaters than previously customary can be used. Details of the temperature course in the yarn duct are not revealed.

These prior art methods either involve no fast moving yarns or, if fast moving yarns are involved, are in some instances run with the heating unit set to very high temperatures in order that the desired temperatures may be obtained on the moving yarn during short residence times, or with relatively large temperature gradients being obtained in the yarn duct of the heating means, since, for example, turbulence arises in the heating medium. Inevitably, the heating will be nonuniform from out to in into the yarn or yarn bundle. The quality of the treated yarns or yarn bundles accordingly leaves in general something to be desired. It is found, in general, that rapid heating with an excessive temperature difference can lead to a loss of strength of the yarn or to uneven dye uptake by the yarn, since parts of the yarn bundle are heated nonuniformly.

Other prior art heating processes, intended to maximize the uniformity of the heating of the yarn in the yarn duct, require a special form of guiding the heating medium and are expensive to implement.

It is an object of the present invention to provide a simple process for drawing heated contactlessly moving yarns whereby very gentle and very uniform heating of the yarns is possible.

SUMMARY OF THE INVENTION

It has now been found, surprisingly, that yarns moving contactlessly through a heating apparatus at high speed can be heated to a desired elevated temperature and drawn in a gentle manner.

The process of the invention comprises the following measures:

i) preheating a heat transfer gas to a temperature which is above the desired yarn temperature, and ii) feeding the preheated heat transfer gas into the yarn duct so that it impinges essentially perpendicularly on the moving yarn along a length such that the yarn heats up to the desired elevated temperature within the heating apparatus, the length of the impingement zone being such that continuous removal of the boundary layer by the impinging heat transfer gas ensures that the yarn comes into direct contact with the heat transfer gas and thus heats up very rapidly, and iii) tensioning the yarn moving contactlessly through the heating apparatus in such a way that it undergoes drawing as it passes through said heating apparatus.

In the process of the invention, the uniformly heated heat transfer gas impinges on the yarn over a certain length, so that the heat transport process is due more to the movement of the heat transfer gas (convection) than to heat transmission by temperature gradient. This form of impingement strips the yarn of its thermally insulating boundary layer of air over a considerable length and makes it possible for the hot heat transfer gas to release its heat to the yarn rapidly and uniformly. For this the temperature of the heat transfer gas need be only a little above the yarn temperature, since the bulk of the heat is transferred by convective air movement and only a relatively small proportion by temperature gradient. This convective form of heat transmission is very efficient and, what is more, overheating of the yarn material is avoided, making gentle and uniform heating a reality.

DETAILED DESCRIPTION

Figure 1:
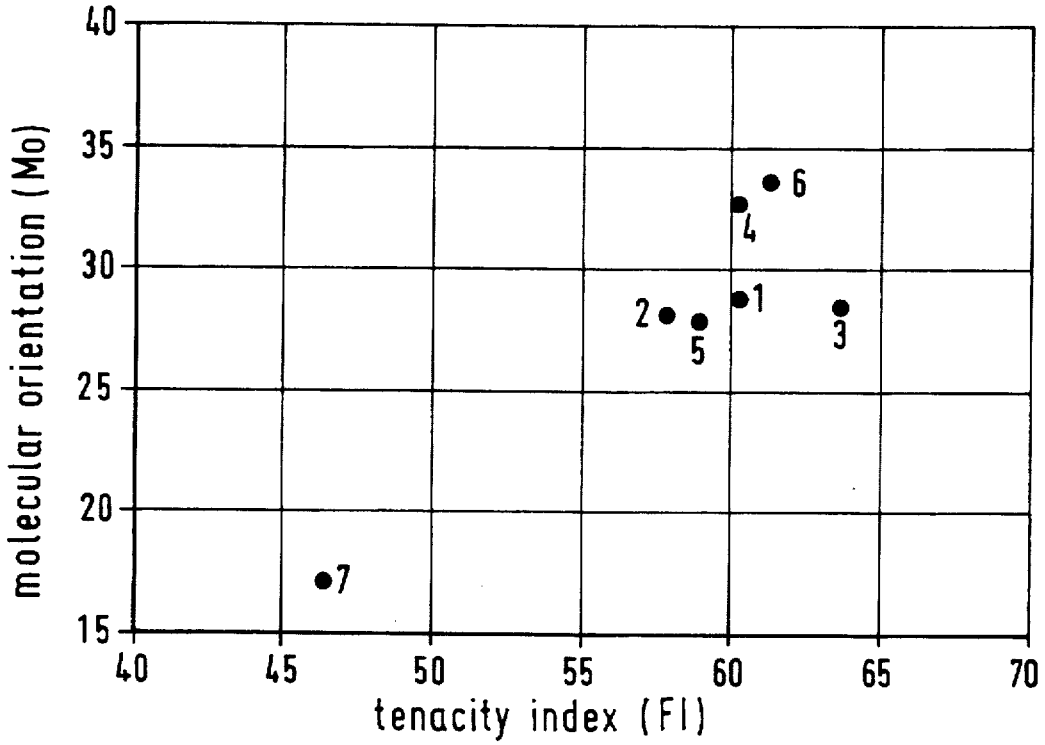
FIG. 1 illustrates the molecular orientation (Ma) vs. the tenacity index (FI) according to the invention.

For the purposes of the present invention the term "yarn" includes not only multifilament yarns but also staple yarns and monofilaments. Depending on the field of use, the yarn will usually have a linear density of from 50 to 2500 dtex, preferably from 50 to 300 dtex (for textile purposes) or from 200 to 2000 dtex (for industrial purposes).

For the purposes of the present invention the term "fiber" is used in its widest sense, for example as meaning yarn as well as staple fiber.

As regards the fiber-forming material, the process of the invention is not subject to any restrictions. It is possible to use not only yarns made of inorganic material, for example glass, carbon or metal yarns, but also yarns made of organic material, for example yarns based on aliphatic or aromatic polyamide, polyesters, in particular polyethylene terephthalate, or polyacrylonitrile.

"High speed" for the purposes of the present invention denotes speeds of more than 300 m/min, preferably from 400 to 6000 m/min, in particular from 400 to 3000 m/min; these particulars relate to the speed of the yarn at the instant of leaving the heating apparatus.

The heat transfer gas used can be any gas which under the particular treatment conditions is inert toward the yarn to be heated. Examples of gases of this type are nitrogen, argon and in particular air. The gas may also contain additaments, for example a certain moisture content; however, the moisture content must not be so high as to result in significant condensation on the yarn in the heating apparatus.

The heat transfer gas can be preheated in a conventional manner, for example by contact with a heat exchanger, by passing through heated tubes or by direct heating via heating spirals. The temperature of the preheated heat transfer gas is above the particular yarn temperature desired; the heat transfer gas preferably has a temperature of up to 20° C. above the desired yarn temperature, and it is preferable to ensure that no significant temperature drop occurs between the preheating and the actual heating of the yarn.

The hot heat transfer gas can be introduced into the yarn duct at any desired point. It is preferably introduced into the yarn duct in such a way that it can come into contact with the yarn along the entire yarn duct. The length of the impingement zone is preferably more than 6 cm, in particular from 6 to 200 cm. If the heating apparatus is integrated into a drawing operation, the impingement zone is preferably from 6 to 20 cm in length. If the heating apparatus is integrated into a setting operation, the impingement zone is preferably from 6 to 120 cm, in particular from 6 to 60 cm, in length.

The heat transfer gas is preferably introduced into the yarn duct perpendicularly to the yarn transport direction, the heat transfer gas on the one hand being carried along by the moving yarn and leaving the heating apparatus together with the moving yarn via the yarn outlet and, on the other, moving in the direction opposite to the yarn transport direction and leaving the heating apparatus via the yarn inlet.

In a preferred embodiment, the heat transfer gas is blown perpendicularly onto the yarn from small openings in the middle portion of the yarn duct over a length of about ¼ to ½ of the duct length and escapes from the yarn duct in the yarn transport direction and in the opposite direction. In a similarly preferred modification of this embodiment, the gas is blown in transversely and aspirated away on the opposite side.

The contacting in the heating apparatus of the moving yarn with the heat transfer gas shall take place under such conditions that the yarn heats up to the desired elevated temperature within the heating apparatus and the heat transfer gas virtually cools down only very little in the heating apparatus.

The person skilled in the art has a number of measures at his or her disposal for achieving these requirements. For instance, it is possible to have the heat transfer gas flow through the yarn duct at a relatively high weight per unit time, relative to the yarn weight moving through the yarn duct per unit time, so that, notwithstanding the effective and rapid transmission of heat to the yarn, the heat transfer gas cools down only slightly. Unlike impingement on the moving yarn at virtually one spot, impingement along a certain zone ensures a particularly intensive interaction of the heating gas with the yarn, since the boundary layer between the yarn and the surrounding medium is continuously stripped away in this zone. In this way it is possible to achieve effective heating of the yarn even with only a small change in the temperature of the gas. Furthermore, the temperature course of the heat transfer gas can be controlled in a conventional manner via the thermal capacity of the gas or its flow velocity.

In a particular embodiment, the heating is controlled by single-location or group control in such a way that the yarn is at a predetermined temperature by controlling the heating via a control circuit with one or more sensors in the vicinity of the yarn. Since the time constant of electronic control circuits is below 1 second, they make it possible to achieve a very short start-up phase, reducing the proportion of off-spec start-up material and eliminating winding waste and the need to switch to saleable packages.

In general there is only a negligible change of the temperature of the heat transfer gas in the heating apparatus under operating conditions; thus this gas does not undergo any significant change in temperature on passing through the heating apparatus. This can be achieved with suitable insulation of the gas-conducting parts of the aparatus.

It is a particular advantage that the above-described temperature control system makes it possible to disregard the heat losses between the heating apparatus and the yarn, since the heating apparatus is controlled according to the temperature close to the yarn. This makes it possible to avoid expensive wall heating in the air duct between the heating apparatus and the yarn. Even local fluctuations in the insulating effect can be eliminated by this form of control.

It is a particular advantage of the drawing process of the invention that it makes it possible to produce fibers possessing enhanced strength and high dimensional stability. The upper limit of the temperature of the heat transfer gas is less critical in the process of the invention, since the compact yarn, owing to its heat content, does not follow the heating gas temperature immediately. It is thus perfectly possible to operate even at heat transfer gas temperatures which are above the melting point of the yarn material.

A suitable value for the rate of throughput of heat transfer gas through the heating apparatus can be estimated by means of an $x_L$ value, which should preferably be exceeded. This $x_L$ value is calculated by the following formula:

$$x_L=1.5*10^{-5}*(v*fd*c_{pf})/(q_L*c_{p1})$$

where $x_L$=gas throughput in standard $m^3/h$ v=yarn speed in m/min fd=yarn linear density in dtex $c_{pf}$=heat capacity of the yarn material in kJ/Kg*K $q_L$=density of the heat transfer gas in $kg/m^3$ $c_{p1}$=heat capacity of the heat transfer gas in kJ/Kg*K Preferred $x_L$ values for a certain combination of yarn material and heat transfer material vary from within the range of the values calculated by the above formula to four times this value. A customary $x_L$ value is 2.2 standard $m^3/h$.

In a particularly preferred version, the process of the invention can be used in the production of high strength multifilament yarns, preferably based on polyester, in particular on polyethylene terephthalate.

In the case of polyethylene terephthalate multifilament yarns, the drawing/setting temperature, controlled via the temperature of the heat transfer gas, is usually set within the range from 160° to 250° C., preferably from 210° to 240° C. The drawing tension is usually from 1.5 to 3.0 cN/dtex, preferably from 2.3 to 2.8 cN/dtex, based on the final linear density.

Polyester multifilament yarns drawn and set in this way surprisingly have an about 5 to 10 cN/tex higher tenacity than polyester multifilament yarns drawn using conventional heat sources.

Polyester fibers drawn in a single stage by the process of the invention (e.g. drawing between feed and take-off godets with heating apparatus in between) unexpectedly exhibit a very high degree of setting and a very high degree of crystallization, possess low residual shrinkage values and hence have a high dimensional stability. Following the single-stage drawing these fibers are industrially usable as low shrinkage fibers, having a shrinkage of less than 8% at 180° C.

To produce low shrinkage polyester fibers by conventional processes requires a second stage in which some of the shrinkage is released at a high temperature. Because of the decrease in orientation as they shrink, these yarns are prone to stretching in the course of further processing. By contrast, the polyester fibers produced according to the invention combine low shrinkage with a very high degree of molecular orientation. With this combination, subsequent stretching is virtually impossible. The fibers obtainable in this way can be characterized in terms of the tenacity index TI and the molecular orientation MO or in terms of the compliance COM and the storage modulus index SMI.

The invention therefore also provides polyester fibers, in particular multifilaments, obtainable by the drawing process of the invention which have the following properties: a tenacity index TI equal to or greater than 50, in particular from 58 to 65, and a molecular orientation MO equal to or greater than 20, in particular from 25 to 35, or a compliance COM equal to or less than 12, in particular from 2 to 8, and a storage modulus index SMI equal to or greater than 100, in particular from 115 to 150, or a combination of the parameters TI, MO, COM and SMI within the above-specified ranges, where $$TI=a_1*T-a_2*BE-a_2*S,$$

$$MO=a_3*SS-a_2*BE-a_2*S,$$

$$COM=a_2*BE+a_2*S-a_4*CAO, \text{ and}$$

$$SMI=a_1*T-4*(a_2*BE+a_2*S)+A_4*CAO+a_3*SS-a_2*DC,$$

in which $a_1=1*$ (tex/cN), $a_2=1*$ (1/%), $a_3=10*$ (sec/km) and $a_4=10*$ (1/%), T is the tenacity in cN/tex, BE is the breaking extension in %, S is the shrinkage in % measured at 200° C. in a through-circulation oven, SS is the speed of sound in kin/see measured at 25° C., CAO is the crystallite axial orientation in % expressed by the Hermann orientation function, and DC is the degree of crystallization in % measured by the method of the density gradient column.

The quantities underlying the above definitions for TI, MO, COM and SMI are determined as follows:

The tenacity T and the breaking extension BE are determined in accordance with DIN 53834 (entitled "Testing of Textiles: Simple tensile test for single and plied yarns in conditioned state"). The pertinent portion of DIN 53834 is section 7 ("Experimental Conditions"), including paragraphs 7.1, 7.2, and 7.3. Section 7 of DIN reads as follows:

7.1 Free clamping distance

The free clamping distance is 500 mm. If the free clamping distance is not, at the same time, the initial length $l_v$, that is to say, if a certain initial length is marked within the free clamping distance, this must be indicated in the test report.

7.2 Pre-stressing force

The pre-stressing force must be selected in such a manner that the fineness-related tensile force in the tensile test lies between 0.4 and 0.6 Cn/tex under normal climate conditions, and between 0.2 and 0.3 Cn/tex in the wet tensile test. The pre-stressing forces calculated on this basis are laid down according to the fineness groups as follows in Table 1.

TABLE 1

| Initial fineness Tt in tex*) | Pre-stressing forces. Pre-stressing forces $F_v$ in cN Tensile test in normal climate | Wet tensile test |
|---|---|---|
| to 1.2 | 0.50 | 0.225 |
| above 1.2 to 1.6 | 0.70 | 0.335 |
| above 1.6 to 2.4 | 1.00 | 0.50 |
| above 2.4 to 3.6 | 1.50 | 0.70 |
| above 3.6 to 54. | 2.25 | 1.00 |
| above 5.4 to 8.0 | 3.35 | 1.50 |
| above 8.0 to 12 | 5.00 | 2.25 |
| above 12 to 16 | 7.00 | 3.35 |
| above 16 to 24 | 10.00 | 5.00 |
| above 24 to 36 | 15.0 | 7.00 |
| above 36 to 54 | 22.5 | 10.0 |
| above 54 to 80 | 33.5 | 15.0 |

TABLE 1-continued

| Initial fineness Tt in tex*) | Pre-stressing forces. Pre-stressing forces $F_v$ in cN Tensile test in normal climate | Wet tensile test |
|---|---|---|
| above 80 to 120 | 50.0 | 22.5 |
| above 120 to 160 | 70.0 | 33.5 |
| above 160 to 240 | 100 | 50 |
| above 240 to 360 | 150 | 70 |
| above 360 to 540 | 225 | 100 |
| above 540 to 800 | 335 | 150 |
| above 800 to 1200 | 500 | 225 |
| above 1200 to 2000 | 800 | 400 |

*)1 tex - 10 dtex

In the case of yarns and twisted threads having a ten-fold or hundred-fold degree of fineness, ten-fold or hundred-fold pre-stressing forces have to be employed. If the specified pre-stressing force is not sufficient to stretch the yarn or twisted thread, then the pre-stressing force must be increased until the yarn or twisted thread is stretched. With textured yarns, at least 1 cN/tex must be selected as the pre-stressing force. Any pre-stressing force that deviates from those cited in Table 1 must be indicated in the test report.

For glass yarns, Section 10 must also be taken into consideration.

7.3 Deformation rate

The deformation rate is defined as the rate at which the two tensioning grips of the tensile test device move away from each other.

The deformation rate is established as follows:

| At maximum tensile-force strain values | the deformation rates equals |
|---|---|
| up to 5% | 50 mm/min |
| up to 40% | 250 mm/min |
| above 49% | 500 mm/min |

The maximum tensile-force strain value has to be determined by preliminary experiments, after which the deformation rate is selected accordingly. Enough preliminary experiments should be carried out in order to ensure that the relative confidence range p of the maximum tensile-force strain mean value resulting from the preliminary experiments is less than 20% of the mean value. Since, in this case, the maximum tensile-force strain mean value obtained from the preliminary experiments could still have a very wide confidence range, it could happen that the maximum tensile-force stain mean value from the preliminary experiments lies within a different range of the maximum tensile-force strain that is decisive for the deformation rate than the maximum tensile-force strain mean value of the measured specimen. In such a case, it is not necessary to conduct a new test, since it suffices to indicate in the test report which deformation rate was used.

When it comes to the selection of the deformation rate in tests for comparison purposes, contrary to the instructions given above, only the same deformation rates should be employed, independently of the magnitude of the tensile-force strain.

In borderline cases, the deformation rate can be freely selected. This should be indicated accordingly in the test report.

The deformation rates given apply to the specified free clamping distance of 500 mm.

If, contrary to the standard procedure, a free clamping distance other than 500 mm is employed, the deformation rates given have to be changed according to the ratio of the selected clamping distance to the total clamping distance of 500 mm.

Remark #1: When employing these guidelines for elongation values below 10% the test time will be shorter than 12 seconds. It must be checked here whether the test device is still capable of precisely detecting the tensile force and change in distance. If necessary, the deformation rate must be reduced to a feasible extent (also see the explanations).

Remark #2: In other publications, the deformation rate is also expressed in "% elongation per minute". Accordingly, the following would apply here: 10%, 50% and 100% elongation per minute. This has the advantage that the deformation rate given does not depend on the free clamping distance.

The shrinkage S is initiated by heat treatment in a through-circulation oven at 200° C. for a residence time of 5 minutes and then measured under a load corresponding to a weight of 500 meters of the starting yarn.

The speed of sound SS is measured under a load of 1 cN/dtex using a Dynamic Modulus Tester PPM-5 from Morgan & Co./Massachusetts USA.

The degree of crystallization DC is determined from the density by the two-phase model assuming the density of the amorphous phase to be 1.331 g/cm$^3$ and the density of the crystalline phase to be 1.455 g/cm$^3$. The density is measured in zinc chloride/water by the gradient method.

The crystallite axial orientation CAO is expressed by the Hermann orientation function $f_c=\frac{1}{2}*(3*<\cos^2(\text{theta})>-1)$. What is measured is the azimuthal intensity distribution of the (−1,0,5) reflex of polyethylene terephthalate and it is used to calculate $f_c$ by the above-specified formula. The X-ray examinations were carried out by the method of Biangardi, Schriftenreihe "Kunststoff-Forschung" 1, TU-Berlin, using a D 500 X-ray diffractometer from Siemens.

The polyester fibers of the invention can be used with advantage in all those fields in which high strength, high modulus and low shrinkage fibers are used.

The polyester fibers of the invention are preferably used as reinforcing materials for plastics or for producing textile fabrics, such as woven or knitted fabrics.

A preferred field of use for the polyester fibers of the invention is the use as reinforcing materials for elastomers, in particular for producing vehicle tires or conveyor belts.

A further preferred use for the polyester fibers of the invention is the production of dimensionally stable textile fabrics, such as tarpaulins.

The Examples which follow describe the invention without limiting it. The values reported in these Examples for TI, MO, COM and SMI were determined in accordance with the above definitions and the above-described measurements for T, BE, S, SS, CAO and DC. Viscosity data in the Examples which follow relate to the intrinsic viscosity, measured on solutions of the polyester in o-chlorophenol at 25° C.

EXAMPLES 1 TO 7

Polyethylene terephthalate (PET) is conventionally melt spun and drawn using a single-stage drawing system comprising feed and take-off godets. Examples 1 to 6 describe embodiments in which the heating apparatus of the invention is used, while Example 7 concerns a commercially available high strength and high modulus PET yarn produced without the heating apparatus of the invention.

Tables Ia, Ib and Ic below show the process conditions and the properties of the yarns obtained.

TABLE Ia

| Ex. No. | Spinning take-off speed m/min | Intrinsic viscosity | Linear density dtex | Filament linear density dtex | Temp. of hot air °C. | Temp. of drawing godet °C. | Speed of drawing godet m/min |
|---|---|---|---|---|---|---|---|
| 1 | 1000 | 0.76 | 138 | 48 | 250 | 230 | 600 |
| 2 | 200 | 0.76 | 194 | 96 | 280 | 230 | 600 |
| 3 | 3000 | 0.76 | 180 | 96 | 320 | 230 | 600 |
| 4 | 2000 | 0.67 | 122 | 32 | 280 | 230 | 600 |
| 5 | 3000 | 0.67 | 126 | 32 | 280 | 230 | 600 |
| 6 | 4000 | 0.67 | 113 | 32 | 300 | 230 | 600 |
| 7 | 1000 | 0.76 | 138 | 32 | | | |

TABLE Ib

| Ex. No. | Tenacity T cN/tex | Breaking extension BE and shrinkage S % | Crystallite axial orientation CAO % | Speed of sound SS km/sec | Degree of crystallization DC % |
|---|---|---|---|---|---|
| 1 | 77.3 | 17.1 | 94.95 | 4.57 | 58.44 |
| 2 | 74.1 | 16.1 | 94.91 | 4.41 | 57.22 |
| 3 | 80 | 16.2 | 94.77 | 4.46 | 56.21 |
| 4 | 73.7 | 13.5 | 95.07 | 4.61 | 60.98 |
| 5 | 74.6 | 15.5 | 94.59 | 4.33 | 57.49 |
| 6 | 74.1 | 12.7 | 95.07 | 4.61 | 59.82 |
| 7 | 70 | 23.5 | 94.53 | 4.05 | 55.41 |

TABLE Ic

| Ex. No. | TI | MO | COM | SMI |
|---|---|---|---|---|
| 1 | 60.2 | 28.6 | 7.605 | 122.535 |
| 2 | 58 | 28 | 6.609 | 120.511 |
| 3 | 63.8 | 28.4 | 6.723 | 125.487 |
| 4 | 60.2 | 32.6 | 3.993 | 136.287 |
| 5 | 59.1 | 27.8 | 6.041 | 122.849 |
| 6 | 61.4 | 33.4 | 3.193 | 138.727 |
| 7 | 46.5 | 17 | 14.047 | 81.363 |

Figure 2:
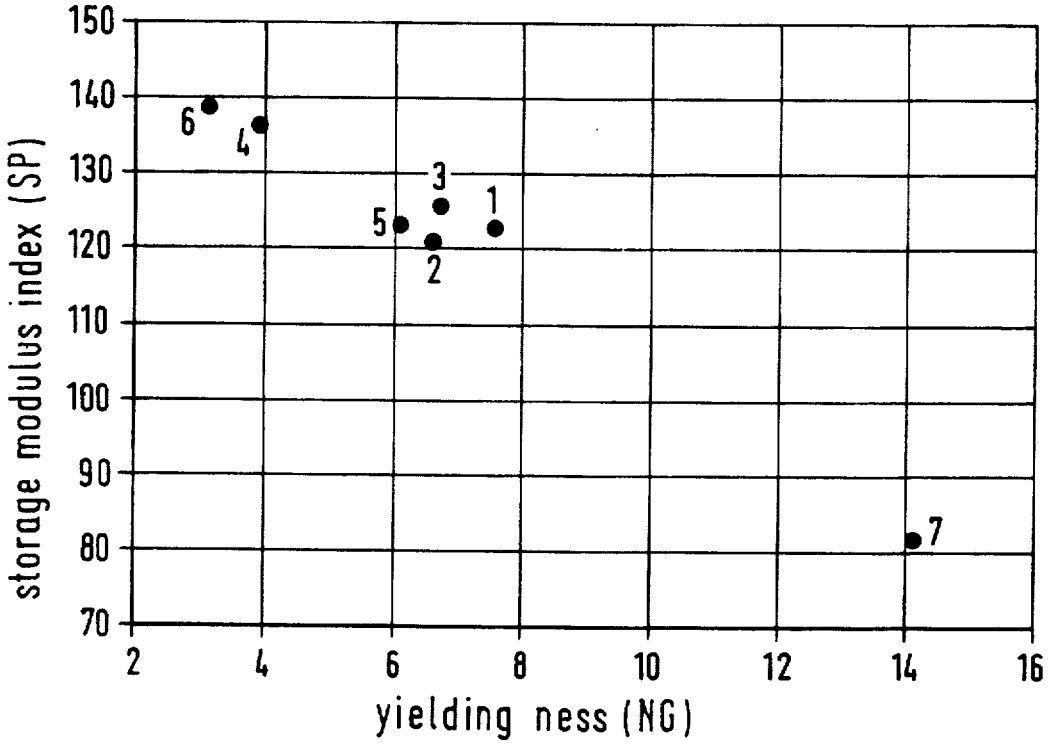
FIG. 2 illustrates the storage modulus index (SP) vs. the yielding ness (NG) according to this invention.

The results shown in Table Ic are depicted in graph form in FIGS. 1 and 2.

What is claimed is:

1. Polyester fibers having a tenacity index TI of equal to or greater than 58 and a molecular orientation MO of equal to or greater than 25, where $$TI=a_1*T-a_2*BE-a_2*S, \text{ and}$$

$$MO=a_3*SS-a_2*BE-a_2*S,$$

in which $a_1=1*$ (tex/cN), $a_2=1*$ (1/%) and $a_3=10*$ (sec/km), T is the tenacity in cN/tex, BE is the breaking extension in %, S is the shrinkage in % measured at 200° C. in a through-circulation oven and SS is the speed of sound in km/sec measured at 25° C.

2. Polyester fibers, as in claim 1 having a compliance COM of equal to or less than 12 and a storage modulus index SMI of equal to or greater than 100, where $$COM=a_2*BE+a_2*S-a_4*CAO, \text{ and}$$

$$SMI=a_1*T-4*(a_2*BE+a_2*S)+A_4*CAO+a_3*SS-a_2*DC,$$

in which $a_1$=1* (tex/cN), $a_2$=1* (1/%), $a_3$=10* (sec/km) and $a_4$=10* (1/%), T is the tenacity in cN/tex, BE is the breaking extension in %, S is the shrinkage in % measured at 200° C. in a through-circulation oven, SS is the speed of sound in km/sec measured at 25° C., CAO is the crystallite axial orientation in % expressed by the Hermann orientation function, and DC is the degree of crystallization in % measured by the method of the density gradient column.

3. The polyester fibers of claim 2, wherein TI is from 58 to 65, MO is from 25 to 35, COM is from 2 to 8 and SMI is from 115 to 150.

4. The polyester fibers of claim 2, wherein the polyester is polyethylene terephthalate.

* * * * *